US007776413B2

(12) United States Patent
Ochiai et al.

(10) Patent No.: US 7,776,413 B2
(45) Date of Patent: Aug. 17, 2010

(54) MELT THERMAL TRANSFER RECORDING PAPER

(75) Inventors: Hisao Ochiai, Kamisu-machi (JP); Takatoshi Nishizawa, Kamisu-machi (JP)

(73) Assignee: Yupo Corporation, Tokyo (JP)

( * ) Notice: Subject to any disclaimer, the term of this patent is extended or adjusted under 35 U.S.C. 154(b) by 0 days.

(21) Appl. No.: 11/075,665

(22) Filed: Mar. 10, 2005

(65) Prior Publication Data

US 2005/0214486 A1 Sep. 29, 2005

Related U.S. Application Data

(63) Continuation of application No. PCT/JP03/11553, filed on Sep. 10, 2003.

(30) Foreign Application Priority Data

Sep. 10, 2002 (JP) ..... 2002-246705

(51) Int. Cl.
*B41M 5/40* (2006.01)

(52) U.S. Cl. ..... 428/32.63; 428/32.39; 428/32.6; 428/32.69; 428/32.71; 428/32.72; 428/32.87

(58) Field of Classification Search ..... 428/32.39, 428/32.6, 32.63, 32.69, 32.87, 32.71, 32.72
See application file for complete search history.

(56) References Cited

U.S. PATENT DOCUMENTS

| | | | | |
|---|---|---|---|---|
| 5,670,225 | A * | 9/1997 | Yamanaka et al. | 428/40.1 |
| 5,712,026 | A | 1/1998 | Amagai et al. | |
| 6,086,987 | A * | 7/2000 | Yamanaka et al. | 428/330 |
| 6,670,027 | B1 * | 12/2003 | Okayama et al. | 428/299.7 |
| 2001/0003626 | A1 * | 6/2001 | Syoda et al. | 428/520 |

FOREIGN PATENT DOCUMENTS

| | | | |
|---|---|---|---|
| JP | 62-148292 | | 7/1987 |
| JP | 62-193836 | | 8/1987 |
| JP | 62-290790 | | 12/1987 |
| JP | 63-152029 | | 6/1988 |
| JP | 63-222891 | | 9/1988 |
| JP | 64-49640 | | 2/1989 |
| JP | 1-95097 | | 4/1989 |
| JP | 5-305780 | | 11/1993 |
| JP | 6-79979 | | 3/1994 |
| JP | 7-25174 | | 1/1995 |
| JP | 7-76186 | | 3/1995 |
| JP | 7-179078 | | 7/1995 |
| JP | 7-232397 | | 9/1995 |
| JP | 8-20169 | | 1/1996 |
| JP | 8-80684 | | 3/1996 |
| JP | 9-76647 | | 3/1997 |
| JP | 9-86057 | | 3/1997 |
| JP | 9-267571 | | 10/1997 |
| JP | 9-295466 | | 11/1997 |
| JP | 10-264543 | | 10/1998 |
| JP | 11-334228 | | 12/1999 |
| JP | 2000-15941 | | 1/2000 |
| JP | 2000-190433 | | 7/2000 |
| JP | 2000-218950 | | 8/2000 |
| JP | 2000-247048 | | 9/2000 |
| JP | 2001-18542 | | 1/2001 |
| JP | 2001-219661 | | 8/2001 |
| JP | 2001-225422 | | 8/2001 |
| WO | WO 98/37128 | * | 8/1998 |

OTHER PUBLICATIONS

Japanese Industrial Standards (JIS),—Plastics—Thermoplastic materials—K 7206:1999, Determination of Vicat softening temperature (VST).

Japanese Industrial Standard, Test method for colour fastness to rubbing, JIS L 0849, 1996.

Japanese Industrial Standard, JIS B 0601, 2001, Geometrical Product Specifications (GPS)—Suface texture: Profile method-Terms, definitions and surface texture parameters.

* cited by examiner

*Primary Examiner*—Betelhem Shewareged
(74) *Attorney, Agent, or Firm*—Oblon, Spivak, McClelland, Maier & Neustadt, L.L.P.

(57) ABSTRACT

A melt thermal transfer recording paper suitable for melt thermal transfer recording comprising a stretched resin film, wherein stretched resin film contains from 30 to 75% by weight of an inorganic fine powder and/or an organic filler and from 25 to 70% by weight in total of a thermoplastic resin having a Vicat softening point of not higher than 140° C. and a polyolefin-based resin having a Vicat softening point of higher than 140° C.; the stretched resin film contains more than 75 parts by weight and at most 900 parts by weight of the thermoplastic resin relative to 100 parts by weight of the polyolefin-based resin.

23 Claims, No Drawings

MELT THERMAL TRANSFER RECORDING PAPER

The present application is a continuation of PCT/JP03/11553 with a filing date of Sep. 10, 2003, which claims the priority from Japanese Patent Application No. 264705/2002 filed on Sep. 10, 2002.

BACKGROUND OF THE INVENTION

1. Field of the Invention

The present invention relates to a melt thermal transfer recording paper. More precisely, the invention relates to a melt thermal transfer recording paper which exhibits good ink transferability and adhesiveness in various printing systems and which, especially when used in a melt thermal transfer recording device, exhibits good hot-melt ink transferability and adhesiveness and good water resistance and solvent resistance.

2. Description of the Related Art

An image recording method includes a sublimation thermal transfer system, a melt thermal transfer system, an electrophotographic system and an electrostatic recording system, and these are widely utilized for recording images and informations. In these, thermal energy is used for transfer and for image fixation and adhesion. For example, an original is pressed against a recording medium via an ink ribbon therebetween so that the colorant is transferred from the ink ribbon to the recording medium, or a toner is transferred onto a recording medium and then adhered thereto by heating it with a high-temperature roll or under light.

Of those, the melt thermal transfer system is generally used for information recording of barcodes and others, and this is driven as follows: A thermal transfer ink ribbon comprising a hot-melt ink and a substrate to support it, and a recording paper are put between a printing head equipped with a thermal head or the like serving as a heat source, and a drum. With that, the thermal head is controlled by an electric signal applied thereto, whereby the hot-melt ink in the thermal transfer ink ribbon is heated and melted, and the resulting ink melt is directly transferred onto the recording paper.

In many cases, the recording paper used in such a melt thermal transfer system has, as its surface, a polyester resin or epoxy resin layer and a primer layer of good adhesiveness to hot-melt ink.

The recording paper of the type is generally a synthetic paper that comprises a stretched film of a propylene-based resin containing an inorganic fine powder such as calcined clay or calcium carbonate (e.g., see JP-A 62-290790, 63-152029, 62-193836, 63-222891, 01-49640, 01-95097, 05-305780, 06-79979, 07-25174, 07-76186, 07-179078, 07-232397, 08-20169, 11-334228, 2000-15941), as well as a stretched polyethylene terephthalate film or a polyolefin-based resin film. Further, the surface of these films is coated with a pigment coating agent that contains an inorganic fine powder such as silica or calcium carbonate and a binder, thereby forming an image-receiving layer thereon so as to increase the whiteness, the colorability and the printability of the films, and these films are used (e.g., see JP-A09-86057, 09-267571, 10-264543, 2000-190433, 2000-218950, 2000-247048, 2001-18542, 2001-225422).

Another type of recording paper is proposed, which comprises a stretched film of an inorganic fine powder-containing polyolefin-based resin and which has an image-receiving layer formed by applying thereto a water-soluble primer of a nitrogen-containing polymer compound for improving the printability and the antistatic property of the film (e.g., JP-A 62-148292). However, when the recording paper is used, then the moisture-absorbing aqueous primer layer absorbs water in high-temperature and high-humidity environments, therefore interfering with the transfer of a hot-melt ink onto it and, as a result, there occur problems in that the lines of the printed barcodes and others may be cut and the printed images may be blurred.

To solve the problems, still another type of recording paper is reported, which is fabricated by applying a water-soluble primer of a nitrogen-containing polymer compound to a stretched porous film of a polyolefin-based resin film that contains an inorganic fine powder of finer particles. It is said that the recording paper may form sharp images thereon even in high-temperature and high-humidity environments (e.g., JP-A 8-80684, 9-76647, 9-295466). However, it is known that, when the printed matter formed by printing on these recording materials is left in high-temperature and high-humidity environments for a long period of time, then there occurs a problem of ink adhesion failure in these.

To further solve the problem, still another technique is reported, which comprises forming a specific image-receiving layer on a recording medium. It is said that, even when the printed matter is left in high-temperature and high-humidity environments for a long period of time, the ink adhesiveness thereto is still good (e.g., JP-A 2001-219661).

However, when barcodes are printed on the recording paper of the type by the use of a melt thermal transfer recording device and when the printed matter is used for information management of drums or containers that contain an organic solvent or the like, then the contents of organic solvent may leak out of them and there occurs a problem in that the hot-melt ink or the image-receiving layer may be dissolved by the organic solvent and the printed information may peel away, and this interferes with the information management. For these reasons, the market much desires the improvement of the recording paper.

SUMMARY OF THE INVENTION

Given that situation, an object of the invention is to provide a melt thermal transfer recording paper, especially which, even when rubbed while exposed to organic solvent, does not interfere with information management and which exhibits improved suitability for various printing systems.

We, the present inventors have assiduously studied in consideration of the prior-art problems as above and, as a result, have found that a melt thermal transfer recording paper of the invention can attain the object. The melt thermal transfer recording paper comprises a resin film stretched in at least one direction, and is characterized in that it contains from 30 to 75% by weight of an inorganic fine powder and/or an organic filler and from 25 to 70% by weight in total of a thermoplastic resin having a Vicat softening point, as measured according to JIS-K-7206-1999, of not higher than 140° C., and a polyolefin-based resin having a Vicat softening point, as measured according to JIS-K-7206-1999, of higher than 140° C.; the stretched resin film contains more than 75 parts by weight and at most 900 parts by weight of the thermoplastic resin relative to 100 parts by weight of the polyolefin-based resin; when a barcode is printed on the surface of the stretched resin film with a meltable wax ink ribbon, by the use of a melt thermal transfer recording device at a temperature of 110° C. and at a printing speed of 3 inches/sec, and when the surface of the printed barcode is rubbed 50 times with a white cotton cloth absorbing ethanol, according to JIS-L-0849-1996, then the condition of the thus-rubbed barcode is on a level of A to C in ANSI GRADE.

When an inorganic fine powder and/or an organic filler are infiltrated into a polyolefin-based resin film and when the film is stretched at least on one direction, then fine recesses are formed in the surface of the film and microvoids are formed inside the film. Since the resin film contains a thermoplastic resin having a Vicat softening point of not higher than 140° C., a thermal transfer ink that has melted owing to the heat and pressure of the thermal head in a melt thermal transfer printing process may readily enter these recesses and microvoids. Then, the thermoplastic resin of the film surface undergoes plastic deformation, and this covers the surface layer of these recesses and microvoids. Accordingly, the thermal transfer ink is trapped inside the film and, as a result, even when the printed film is rubbed while exposed to an organic solvent, there is little ink dissolution from it.

These phenomena can be confirmed from the fact that, when the surface of the stretched resin film of the invention is heated by the use of a melt thermal transfer recording device at a temperature of 110° C. and at a printing speed of 3 inches/sec, then the coated surface area of the thus-heated, stretched resin film is at least 35%.

Preferably, the polyolefin-based resin is a propylene-based resin having a Vicat softening point of higher than 140° C.

Also preferably, the film surface has a center line average height (Ra) of from 0.4 to 2.5 μm.

Also preferably, the film contains a filler dispersant. Preferably, the dispersant content is over 0% by weight and at most 20% by weight.

Also preferably, a coating layer of a polyimine copolymer of the following formula (a) or a polyaminepolyamide-ethyleneimine adduct is provided on the film surface for improving various printability of the film.

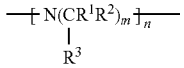

(a)

wherein $R^1$ and $R^2$ each independently represent a hydrogen atom, a linear, branched or alicyclic alkyl group having from 1 to 10 carbon atoms, or an aryl group; $R^3$ represents a hydrogen atom, an alkyl group having from 1 to 20 carbon atoms, an allyl group, an alicyclic alkyl group, an aryl group, or their hydroxide; m indicates an integer of from 2 to 6; n indicates an integer of from 20 to 3000; and (m×n) $R^1$'s, $R^2$'s and $R^3$'s may be individually the same or different.

Also preferably, the coating layer contains any of a water-soluble epoxy-type crosslinking agent, isocyanate-type crosslinking agent, formalin-type crosslinking agent, oxazoline-type crosslinking agent or polyaminepolyamide-epichlorohydrin adduct-type crosslinking agent, and a polymer-type antistatic agent.

The melt thermal transfer recording paper may be printed in various methods. It may be laminated with any other resin film or a material except resin film, or it may be laminated with a release paper via an adhesive therebetween so that it may be used as a material for labels.

The invention further includes recorded matter of the above-mentioned melt thermal transfer recording paper, laminate or label material.

The melt thermal transfer recording paper of the invention is excellent not only in the hot-melt ink transferability and adhesiveness and the waterproofness but also in the solvent-resistant rubbing resistance thereof. In particular, even when rubbed while exposed to organic solvent, it does not interfere with information management and it exhibits improved suitability for various printing systems. Having these characteristics, the melt thermal transfer recording paper of the invention is acceptable in many applications.

BEST MODE FOR CARRYING OUT THE INVENTION

The melt thermal transfer recording paper of the invention is described in more detail hereinunder. In this description, the numerical range expressed by the wording "a number to another number" means the range that falls between the former number indicating the lowermost limit of the range and the latter number indicating the uppermost limit thereof.

[1] Melt Thermal Transfer Recording Paper:

(1) Layer Constitution:

The melt thermal transfer recording paper of the invention may be single-layered or multi-layered; it may have a two-layered structure of a base layer and a surface layer, or may have a three-layered structure that comprises a base layer and has a surface layer on both the surface and the back of the base layer, or may have a multi-layered structure that comprises a base layer and a surface layer and has any other resin film layer between them. Regarding the number of stretch axes, the three-layered structure includes one axis/one axis/one axis; one axis/one axis/two axes; one axis/two axes/one axis; two axes/one axis/one axis; one axis/two axes/two axes; two axes/two axes/one axis, two axes/two axes/two axes. In the multi-layered structures over it, the number of stretch axes may be combined in any desired manner.

The melt thermal transfer recording paper of the invention may be laminated with any other thermoplastic resin film, pulp paper, plain weave fabric (pongee) or nonwoven fabric (spun-bond fabric) into laminates. If desired, an adhesive layer or a release paper may be provided on it. In such a case, the stretched resin film shall be the outermost layer.

(2) Thermoplastic Resin Having a Vicat Softening Point of not Higher than 140° C.:

The thermoplastic resin for use in the invention has a Vicat softening point of not higher than 140° C. as measured according to HIS-K-7206-1999. Preferably, it has a Vicat softening point of from 50 to 130° C., more preferably from 60 to 125° C. The stretched resin film to constitute the melt thermal transfer recording paper of the invention contains more than 75 parts by weight and at most 900 parts by weight, preferably from 100 parts by weight to 700 parts by weight, more preferably more than 100 parts by weight and at most 400 parts by weight of the thermoplastic resin relative to 100 parts by weight of the polyolefin-based resin.

If the Vicat softening point of the resin is higher than 140° C., then the plastic deformation of the film surface owing to the heat of the thermal head in melt thermal transfer printing on the film is unsatisfactory and therefore the coated area ratio of the surface of the stretched film may be small. As a result, when the printed surface is rubbed with solvent, then the thermal transfer ink may readily dissolve out and the object of the invention could not be attained.

If the content of the thermoplastic resin is smaller than 75 parts by weight relative to 100 parts by weight of the polyolefin-based resin, then the amount of the resin that may undergo plastic deformation is small and therefore the coated area ratio of the surface of the film may also be small. As a result, when the printed surface is rubbed with solvent, then the thermal transfer ink may readily dissolve out. On the other hand, if the content of the thermoplastic resin is more than 900 parts by weight relative to 100 parts by weight of the polyolefin-based resin, then the film may stick to production devices such as rolls and tenters during stretching or the film may be broken and is therefore difficult to stretch.

The thermoplastic resin having a Vicat softening point of not higher than 140° C. for use herein include random propylene copolymers with a comonomer of ethylene or butene; polyethylene-based resins such as high-density polyethylene having a density of from 0.940 to 0.970 g/cm$^3$, low-density polyethylene having a density of from 0.900 to 0.935 g/cm$^3$, linear low-density polyethylene having a density of from 0.880 to 0.940 g/cm$^3$, an ethylene/vinyl acetate copolymer; acrylic acid-based resins such as ethylene/acrylic acid copolymer, ethylene/alkyl acrylate copolymer, ethylene/alkyl methacrylate copolymer, ethylene/methacrylic acid copolymer metal salt (e.g., Zn, Al, Li, L, Na); and ionomers, polybutene-1, polybutadiene, methacrylic resins, etc. Of those, preferred are high-density polyethylene, low-density polyethylene, random polypropylene copolymers and acrylic acid-based resins in view of their chemical resistance and costs. More preferred are high-density polyethylene and low-density polyethylene.

(3) Polyolefin-Based Resin:

The polyolefin-based resin for use in the invention is preferably a propylene-based resin having a Vicat softening point, as measured according to JIS-K-7206-1999, of higher than 140° C. The advantages of the propylene-based resin having a Vicat softening point of higher than 140° C. are that the resin facilitates formation of recesses and microvoids in the surface of the stretched film and the surface roughness of the film may suitably increase, and therefore the parts that receive the thermal transfer ink melted by the heat of thermal head increase.

The propylene-based resin is preferably an isotactic polymer and an syndiotactic polymer produced through homopolymerization of propylene. Also usable herein are polypropylene-based copolymers of various stereospecificity, which are produced through copolymerization of propylene with an α-olefin such as ethylene, 1-butene, 1-hexene, 1-heptene, 4-methyl-1-pentene. The copolymers may be binary, ternary or more polynaryones. One alone selected from the above-mentioned polyolefin-based resins may be used, or two or more selected from them may be combined and used herein.

(4) Inorganic Fine Powder:

The inorganic fine powder for use in the invention may have a mean particle size of generally from 0.05 to 10 μm, preferably from 0.1 to 7 μm, more preferably from 0.3 μm to 5 μm, even more preferably from 0.4 μm to 2.5 μm, most preferably from 0.5 μm to 1.5 μm. If the mean particle size thereof is smaller than 0.05 μm, then the inorganic fine powder could not uniformly disperse in the thermoplastic resin having a Vicat softening point of not higher than 140° C. and the polyolefin-based resin when it is melt-kneaded with them, or the inorganic fine powder may form secondary aggregates, or it may adsorb water and may foam owing to the influence of the adsorbed water. If the mean particle size of the powder is larger than 10 μm, then the strength of the film may lower and, in addition, the density of the transferred printing ink or hot-melt ink may lower. Concretely, the inorganic fine powder usable herein includes calcium carbonate, aluminosilicate, alumina, calcined clay, silica, diatomaceous earth, talc, titanium oxide, barium sulfate. Of those, preferred is calcium carbonate in view of its cost. More preferred is calcium carbonate having a small mean particle size and a small particle size distribution, from which coarse particles have been removed (e.g., Maruo Calcium's Caltex 7), as it increases the density of the transferred printing ink.

The particle size of the inorganic fine powder for use in the invention is measured with a particle sizer, for example, a laser diffraction-type particle sizer Microtrack (trade name by Nikkiso KK), and the data of cumulative 50% particles are computed to obtain the mean particle size in terms of the 50% cumulative particle size of the particles.

(5) Organic Filler:

The organic filler for use in the invention has a particle size, in terms of the mean particle size of its dispersion, of generally from 0.05 to 10 μm, preferably from 0.1 to 7 μm, more preferably from 0.3 to 5 μm.

Concretely, the organic filler includes polyethylene terephthalate, polybutylene terephthalate, polycarbonate, nylon-6, nylon-6,6, cyclic olefin homopolymer, cyclic olefin/ethylene copolymer and the like having a melting point of from 160° C. to 300° C. or a glass transition temperature of from 160° C. to 280° C.

The inorganic fine powder and the organic filler may be used either singly or as combined. The content of the powder and/or the filler in the stretched resin film may be from 30 to 75% by weight, preferably from 40 to 65% by weight. If the content is smaller than 30% by weight, then recesses and microvoids will be difficult to form in the film surface and therefore the surface roughness of the film is small and, as a result, the parts that receive the thermal transfer ink melted by the heat of thermal head are small and, even when the surface is coated, the amount of the ink to be trapped in it is small and the object of the invention could not be attained. If the content is larger than 75% by weight, then the strength of the surface of the melt thermal transfer recording paper may lower and the surface may be brittle and may be readily scratched and, as a result, the object of the invention could not be attained.

(6) Dispersant:

The dispersant usable in the invention includes, for example, an acid-modified polyolefin and a silanol-modified polyolefin. Of these, preferred is an acid-modified polyolefin. The acid-modified polyolefin includes acid anhydride group-containing polyolefins produced through random copolymerization or graft copolymerization with maleic anhydride; carboxylic acid group-containing polyolefins produced through random copolymerization or graft copolymerization with an unsaturated carboxylic acid such as methacrylic acid or acrylic acid; and epoxy group-containing polyolefins produced through random copolymerization or graft copolymerization with glycidyl methacrylate. Concretely, they are maleic anhydride-modified polypropylene, maleic anhydride-modified polyethylene, acrylic acid-modified polypropylene, ethylene/methacrylic acid random copolymer, ethylene/glycidyl methacrylate random copolymer, ethylene/glycidyl methacrylate graft copolymer, glycidyl methacrylate-modified polypropylene. Of those, preferred are maleic anhydride-modified polypropylene and maleic anhydride-modified polyethylene.

The dispersant, if any, in the resin film improves the dispersibility of the inorganic fine powder or the organic filler therein, and therefore especially improves the solvent-resistant rubbing resistance of the melt thermal transfer ink on the film.

Specific examples of maleic anhydride-modified polypropylene and maleic anhydride-modified polyethylene are Mitsubishi Chemical's ModicAP[P513V] and ModicAP[M513] (trade names); Sanyo Chemical Industry's Yumex 1001, Yumex 1010 and Yumex 2000 (trade names); and Mitsui DuPont Polychemical's HPR[VR101] (trade name).

Preferably, the acid-modified polyolefin has a degree of acid modification of from 0.01 to 20%, more preferably from 0.05 to 15%, even more preferably from 0.1 to 10%.

If the degree of acid modification is smaller than 0.01%, then the dispersibility of the inorganic fine powder in the thermoplastic resin may be insufficient; but if larger than 20%, then the heat resistance of the acid-modified polyolefin may be too low and the polymer may readily color when thermoformed.

The content of the dispersant is preferably more than 0% by weight and at most 20% by weight, more preferably more than 0% by weight and at most 10% by weight, even more preferably from 0.1 to 5% by weight, still more preferably from 0.15 to less than 2% by weight, most preferably from 0.2 to 1.7% by weight.

If the content of the dispersant is larger than 20% by weight, then the thermal degradation product of the resin composition may increase while the composition is shaped, and the stretchability of the resin film may greatly lower and the film may be frequently broken while formed.

(7) Lubricant:

A lubricant may be used for improving the formability of the stretched resin film of the invention. It is effective for reducing the intermolecular friction force of the resin melt in an extruder or for reducing the friction force between the inner wall of an extruder and the resin melt, thereby increasing the flowability of the resin melt. Its amount to be used is generally from 0.01 to 4% by weight. Concretely, the lubricant usable herein includes higher fatty acids such as oleic acid, stearic acid, and their salts; alcohols such as higher alcohols, polyalcohols, polyglycols, polyglycerols; esters of fatty acids with aliphatic alcohols, aromatic alcohols or polyglycols; and natural waxes, fatty acid amides.

(8) Other Additives:

If desired, the stretched resin film that constitutes the melt thermal transfer recording paper of the invention may contain a stabilizer and a light stabilizer added thereto.

The amount of the stabilizer, if added thereto, may be generally from 0.001 to 1% by weight. Concretely, herein usable are steric-hindered phenolic, phosphorus-containing or amine-type stabilizers.

The amount of the light stabilizer, if added to the film, may be generally from 0.001 to 1% by weight. Concretely, herein usable are steric-hindered amine-type, benzotriazole-type or benzophenone-type light stabilizers.

(9) Forming Method:

The method of forming the melt thermal transfer recording paper of the invention is not specifically defined, and it may be formed in any known method selected in any desired manner. For example, herein employable for forming it are a casting method of sheetwise extruding a resin melt through a single-layered or multi-layered T-die or I-die connected to a screw extruder; a calendering method; a rolling method; an inflation method; and a method of casting or calendering a mixture of a thermoplastic resin and an organic solvent or oil followed by removing the solvent and the oil.

For film stretching, various known methods may be employed.

Concretely, the stretching includes machine-direction stretching for which the peripheral speed difference between rolls is utilized; cross-direction stretching to be attained by the use of a tenter oven; rolling; and co-biaxial stretching to be effected by a combination of a tenter oven and a linear motor.

The stretching temperature may fall between a temperature not lower than the Vicat softening point of the thermoplastic resin used herein, of which the Vicat softening point is not higher than 140° C., and a temperature not higher than the melting point of the polyolefin-based resin used herein (preferably a temperature lower by 2 to 20° C. than the melting point of the resin). Preferably, the stretching speed falls between 20 and 350 m/min.

The draw ratio is suitably determined in consideration of the properties of the polyolefin-based resin and the thermoplastic resin having a Vicat softening point of not higher than 140° C. For example, when the resin film is stretched in one direction, the draw ratio is generally from 2 to 12 times, but preferably from 3 to 10 times, more preferably from 4 to 8 times. When it is stretched in two directions, then the draw ratio is generally from 4 to 80 times as an a real draw ratio, but preferably from 10 to 65 times, more preferably from 20 to 50 times.

(10) Film Thickness:

The thickness of the melt thermal transfer recording paper of the invention may be from 0.5 μm to 1000 μm, preferably from 1 μm to 500 μm.

When the resin film is laminated simultaneously with its formation in a mode of coextrusion or extrusion lamination, or when it is laminated with any other resin film or with any other material than resin film after its formation, then the resulting laminates preferably have a thickness of from 20 μm to 3000 μm, more preferably from 30 μm to 2000 μm.

[2] Coating Agent:

(1) Constitutive Material:

Component (i):

When a coating layer comprising a component (i), a polyimine-based copolymer or a polyaminepolyamide-ethyleneimine adduct is provided on the melt thermal transfer recording paper of the invention, then it improves the adhesiveness of the recording paper to printing ink, especially the adhesiveness thereof to UV-curable ink thereto. The compound includes polyethyleneimine, poly(ethyleneimine-urea) and polyaminepolyamide-ethyleneimine adducts, as well as their alkyl-modified derivatives, cycloalkyl-modified derivatives, aryl-modified derivatives, allyl-modified derivatives, aralkyl-modified derivatives, alkylaryl-modified derivatives, benzyl-modified derivatives, cyclopentyl-modified derivatives, or aliphatic cyclic hydrocarbon-modified derivatives, and their hydroxides. The component includes one or more of these either singly or as combined.

Of those, preferred for use herein is the polyimine-based polymer of the above-mentioned formula (a) from the viewpoint of its ability to improve the adhesiveness and the transferability of offset ink thereto. The degree of polymerization of polyethyleneimine herein may be any one, preferably falling between 20 and 30,000.

Component (ii):

When a crosslinking component (ii), a water-soluble epoxy-type resin, isocyanate-type resin, formalin-type resin or oxazoline-type resin is added to the component (i), then it further improves the waterproof adhesiveness of the recording paper to printing ink. For the crosslinking agent, especially preferred are bisphenol A-epichlorohydrin resins, polyaminepolyamide-epichlorohydrin resins, aliphatic epoxy resins, epoxy-novolak resins, alicyclic epoxy resins and bromoepoxy resins; and most preferred are polyaminepolyamide-epichlorohydrin adducts, and monofunctional to polyfunctional glycidyl ethers and glycidyl esters.

Component (iii):

In addition to the components (i) and (ii), another component (iii), a polymer-type antistatic agent may be added to the coating layer, and it reduces the troubles to be caused by dust adhesion to the layer or by electric charging during letter or pattern printing. For the polymer-type antistatic agent, herein usable are cationic, anionic, ampholytic or nonionic agents. The cationic agent includes ammonium salt structure or phosphonium salt structure-having compounds. The anionic agent includes compounds having, in the molecular structure thereof, an alkali metal salt structure of a sulfonic acid, phosphoric acid or carboxylic acid, such as an alkali metal salt (e.g., lithium salt, sodium salt, potassium salt) structure of acrylic acid, methacrylic acid or maleic acid (anhydride).

The ampholytic agent contains the two structures of the above-mentioned cationic structure and anionic structure in one molecule. For example, it includes betaine compounds. The nonionic agent includes alkyleneoxide structure-having ethyleneoxide polymers, and polymers having an ethyleneoxide polymer component in the molecular chain. In addition, compounds having a boron in the molecular structure are also examples of the polymer-type antistatic agent. Of those, preferred are nitrogen-containing polymer-type antistatic agents; and more preferred are tertiary nitrogen or quaternary nitrogen-containing acrylic polymers. The coating agent for use in the invention may optionally contain a defoaming agent and any other additives not interfering with the printability and the thermal transferability of the recording paper of the invention.

(2) Weight Ratio:

The ratio of the components (ii) and (iii) to 100 parts by weight of the component (i) of the coating agent for use in the invention is as follows:

Component (ii), generally from 0 to 400 parts by weight, preferably from 50 to 300 parts by weight.

Component (iii), generally from 0 to 800 parts by weight, preferably from 25 to 500 parts by weight.

(3) Condition of Coating Agent:

The components of the coating agent are used after dissolved in a solvent such as water, or methyl alcohol, ethyl alcohol, isopropyl alcohol, acetone, methyl ethyl ketone, ethyl acetate, toluene or xylene. In general, they are used as their solutions in water. The solution concentration may be generally from 0.5 to 40% by weight, but preferably from 1 to 20% by weight.

(4) Coating:

(a) Coating Amount:

The amount of the coating agent to be applied to the melt thermal transfer recording paper may be generally from 0.01 to 3 g/m$^2$, but preferably from 0.01 to 1 g/m$^2$, more preferably from 0.02 to 0.3 g/m$^2$ in terms of the solid content thereof. If the amount is smaller than 0.01 g/m$^2$, then the recording paper could not have a satisfactory antistatic property, and there may occur a trouble in paper feeding in printing and, in addition, the recording paper could not have good adhesiveness to printing ink. However, if the amount is larger than 3 g/m 2, not only then the driability of the recording paper may be poor but also the production cost thereof may increases since the amount of 3 g/m$^2$ is enough.

(b) Coating Device:

For the coating device, herein usable are any of a roll coater, a blade coater, a bar coater, an air knife coater, a size press coater, a gravure coater, a die coater, a lip coater and a spray coater.

Before coated with the coating layer, the melt thermal transfer recording paper of the invention may be subjected to surface oxidation treatment generally employed for film treatment. The treatment includes corona discharge treatment, flame treatment, plasma treatment, glow discharge treatment, and ozone treatment; and one or more of these may be employed herein either singly or as combined. Of those, preferred are corona treatment and flame treatment. In corona treatment, the treatment dose may be generally from 600 to 12,000 J/m$^2$ (from 10 to 200 W·min/m 2), but preferably from 1,200 to 9,000 J/m$^2$ (from 20 to 180 W·min/m$^2$). The treatment dose in flame treatment may be from 8,000 to 200,000 J/m$^2$, preferably from 20,000 to 100,000 J/m$^2$.

[3] Melt Thermal Transfer Printing:

(1) Meltable Wax Ink Ribbon:

The meltable wax ink ribbon comprises, as the base film thereof, a polyester film (3 to 10 μm) coated with a heat-resistant resin layer (1 to 3 μm) on the side thereof to be in contact with a thermal head, and, on the opposite side thereof, the base film is coated with a hot-melt ink according to a gravure coating or roll coating process. The hot-melt ink is solid at room temperature but its viscosity gradually lowers when it is heated, and the thickness of the ink layer on the base film is from 3 to 8 μm.

Regarding its components, the ink of the wax ink ribbon generally comprises from 10 to 20% by weight of a pigment, from 60 to 80% by weight of a wax-type binder, and from 10 to 20% by weight of various additives such as softener and dispersant.

The wax-type binder has a broad melting point range and is characterized in that its viscosity rapidly lowers at a temperature of its melting point or higher, and it enables uniform ink transfer even when there is some temperature fluctuation in its heating region. Concretely, it includes paraffin wax, ester wax and carnauba wax.

(2) Printing Condition:

The printing method with the melt thermal transfer recording paper of the invention is not specifically defined, and any ordinary melt thermal transfer recording device may be used for it. Regarding the concrete printing condition for it, referred to is Test Example 1 given hereinunder.

The melt thermal transfer recording paper of the invention is characterized in that its ANSI GRADE after the solvent rubbing test described in Test Example 2 given hereinunder is on a level of A to C, preferably on a level B.

[4] Surface Properties:

(1) Surface-Coated Areal Ratio After Dummy (Non-Ink) Printing:

The surface-coated areal ratio as referred to herein is determined according to the process mentioned below.

Using a melt thermal transfer recording device, a thermal transfer recording paper is directly printed with a thermal head with no ink (dummy printing) on its entire surface. A part of the thus-printed film is cut out, and stuck to a sample stand. Its surface to be observed is plated with gold in a mode of vacuum evaporation, and this is photographed with a scanning electromicroscope, Hitachi's S-2400 (trade name), at a magnification power of 2000 times. The part of the surface covered by the heat of the thermal head is traced onto a tracing film, and the drawing of the covered part is analyzed with an image analyzer, Model Luzex IID (trade name by Nireco) to thereby determine the surface-coated areal ratio of the stretched resin film.

After dummy-printed with a melt thermal transfer recording device, the surface-coated areal ratio of the melt thermal transfer recording paper of the invention is preferably at least 35%, more preferably at least 40%, even more preferably from 50% to 100%.

When printed in a mode of melt thermal transfer printing, the thermoplastic resin having a Vicat softening point of not higher than 140° C. undergoes plastic deformation on its film surface owing to the heat of the thermal head applied thereto, and therefore it fuses with the hot-melt ink applied thereto. Accordingly, even when rubbed while exposed to organic solvent, the ink hardly dissolves out of the printed surface of the resin film.

However, even though the surface-coated areal ratio is at most 35%, the organic solvent-resistant rubbing resistance of the resin film is not still good if the amount of the inorganic fine powder and/or the organic filler in the resin film is smaller than 30% by weight. This is because the recesses and the microvoids in the film surface before the thermal transfer operation are not enough in that condition, and therefore the amount of the hot-melt ink to be in the recesses and the microvoids is not enough.

(2) Center Line Average Height (Ra):

The center line average height (Ra) as referred to herein is determined according to JIS-B-0601-2001, using Kosaka Kenkyusho's three-dimensional roughness meter, SE-3AK (trade name) and analyzer, Model SPA-11 (trade name).

Preferably, the center line average height (Ra) of the melt thermal transfer recording paper of the invention is from 0.4 to 2.5 μm, more preferably from 0.45 to 2.0 μm, even more preferably from 0.5 to 0.8 μm.

If the center line average height is smaller than 0.4 μm, then fine recesses could not be formed in the film surface, and the parts that may receive the thermal transfer ink melted by the heat of thermal head are small and, as a result, the amount of the ink to be trapped in the parts is therefore small and the object of the invention could not be attained. If so, in addition, the scratch resistance of the resin film when scratched with a sharp tool may be poor. On the other hand, if the center line average height is larger than 2.5 μm, then the transferability of printing ink and melt thermal transfer ink onto the resin film may be poor, and, if so, the prints may be partly lost or could not have the intended density.

[5] Lamination:

Not specifically defined, various known methods may be employed for lamination in the invention. Concretely, herein employable are a multi-layer die system of using a feed block and a multi-manifold; and an extrusion lamination system of using plural dies. A multi-layer die may be combined with extrusion lamination for use herein. In addition, also usable are any other known lamination methods of, for example, dry lamination or wet lamination with adhesive, or using a hot-melt adhesive.

[6] Adhesive:

The adhesive is typically a rubber-type adhesive, an acrylic adhesive and a silicone-type adhesive. Examples of the rubber-type adhesive are polyisobutylene rubber, butyl rubber and their mixture, and those prepared by adding a tackifier of abietic acid rosin ester, terpene-phenol copolymer, terpene-indene copolymer or the like to the rubber-type adhesive. Examples of the acrylic adhesive are 2-ethylhexyl acrylate/n-butyl acrylate copolymer, 2-ethylhexyl acrylate/methyl acrylate/methyl methacrylate copolymer and the like having a glass transition point of not higher than −20° C.

Regarding its condition, the adhesive may be any of solvent-type, emulsion-type or hot-melt adhesives. In general, however, solvent-type or emulsion-type adhesives are used for lamination.

Application of the adhesive may be attained by the use of a roll coater, a blade coater, a bar coater, an air knife coater, a gravure coater, a reverse coater, a die coater, a lip coater, a spray coater, or a comma coater. If desired, the coated surface may be smoothed or dried to form the adhesive layer.

One general method of forming the adhesive layer comprises applying an adhesive to a release paper that will be mentioned hereinunder and optionally drying it to form an adhesive layer, and thereafter a melt thermal transfer recording paper is laminated on it. As the case may be, however, an adhesive may be directly applied to a melt thermal transfer recording paper.

The amount of the adhesive to be applied is not specifically defined. In general, however, it may be from 3 to 60 g/m$^2$, but preferably from 10 to 40 g/m$^2$ in terms of its solid content. Preferably, the delamination strength of the adhesive layer is from 200 to 3000 g/20 mm.

If the adhesion power between the melt thermal transfer recording paper and the adhesive is small, it is desirable that an anchor-coating agent is applied to the back of the melt thermal transfer recording paper before the recording paper is coated with the adhesive.

For the anchor-coating agent, usable are polyurethanes, polyisocyanate/polyether-polyols, polyisocyanate/polyester-polyol/polyethyleneimines, alkyl titanates. In general, these are dissolved in an organic solvent such as methanol, ethyl acetate, toluene or hexane, or in water, and are used herein.

The amount of the anchor-coating agent to be applied may be from 0.01 to 5 g/m$^2$, preferably from 0.02 to 2 g/m$^2$ in terms of the solid content thereof applied and dried on the recording paper.

[7] Release Paper:

Further if desired, a release paper may be provided outside the adhesive layer.

The release paper to be provided on the melt thermal transfer recording paper via the adhesive layer therebetween is generally subjected to silicone treatment on the side thereof that is to be in contact with the adhesive layer for the purpose of improving the releasability thereof from the adhesive layer.

The release paper for use herein may be any ordinary one. For example, wood-free paper or kraft paper may be used directly as it is, or after subjected to calendering treatment, or after coated with resin, or after laminated with a film; or glassine paper, coated paper or plastic films subjected to silicone treatment may also be used.

When a release paper is provided on the melt thermal melt thermal transfer recording paper or the laminate of the invention via the above-mentioned adhesive therebetween, then it may be used as a material for labels.

[8] Printing:

The melt thermal transfer recording paper of the invention is usable in various thermal transfer recording systems such as a sublimation thermal transfer system, a melt thermal transfer system, an electrophotographic system and an electrostatic recording system. Of those, a melt thermal transfer system is preferred, as the effect of the invention is more remarkable in the system in that the solvent-resistant rubbing resistance of the transferred or printed images is good.

Regarding the type of the ink ribbon usable herein, there are mentioned wax-type ribbons, resin-type ribbons and wax/resin mixed-type ribbons. In particular, wax-type ink ribbons are preferred.

Various printing modes are employable herein, including not only relief printing but also offset printing, gravure printing and flexographic printing.

The melt thermal transfer recording paper or the laminate for labels of the invention may be printed in various methods as above to form printed letters and/or patterns thereon, and the invention thus provides the printed matter.

The characteristics of the invention are described more concretely with reference to the following Production Examples, Working Examples, Comparative Examples and Test Examples. Production Examples are to demonstrate the production of stretched resin films and components (i) to (iii); Working Examples are to demonstrate the production of melt thermal transfer recording papers that satisfy the conditions of the invention; Comparative Examples are to demonstrate the production of melt thermal transfer recording papers not satisfying the conditions of the invention; and Test Examples are to demonstrate the test and evaluation of the melt thermal transfer recording papers. The material, the amount, the blend ratio, the treatment and the process employed in the following Examples may be varied in any desired manner not overstepping the sprit and the scope of the invention. Accordingly, the invention should not be limitatively interpreted by the following Examples.

Production Example 1

Production of Stretched Resin Film (1) A resin composition (C) prepared by mixing 85% by weight of propylene homopolymer (Nippon Polychem's trade name Novatec PP MA-8; m.p., 164° C.) and 15% by weight of heavy calcium carbonate (Bihoku Funka Kogyo's trade name, Soften 1800) having a mean particle size of 3.0 μm was kneaded in an extruder set at 270° C., sheetwise extruded out of it, and cooled with a cooling device to obtain an unstretched sheet. Next, the sheet was again heated up to 150° C., and stretched 5-fold in the machine direction to obtain an MD-stretched film.

(2) A composition (A) was prepared by mixing 23% by weight of high-density polyethylene (Nippon Polychem's trade name, Novatec HD, HJ360) having a Vicat softening point of 122° C., 16.2% by weight of propylene homopolymer (Nippon Polychem's trade name, Novatec PP MA-3; m.p. 165° C.) having a Vicat softening point of 145° C., 60% by weight of heavy calcium carbonate (Maruo Calcium's trade name, Caltex 7) having a mean particle size of 1.1 μm, and 0.2% by weight of aluminium stearate and 0.6% by weight of oleic acid both serving as a lubricant. Apart from it, a composition (B) was prepared by mixing 55% by weight of propylene homopolymer (Nippon Polychem's tradename, Novatec PPMA-3; m.p., 165° C.) and 45% by weight of heavy calcium carbonate (Bihoku Funka Kogyo's trade name, Soften 1800) having a mean particle size of 3.0 μm. These compositions (A) and (B) were separately melt-kneaded in different extruders set at 270° C., then laminated inside a die and coextruded out of it. This was laminated on the 5-fold MD-stretched film obtained in the above step (1) in such a manner that the layer (A) could be the surface layer of the resulting laminate.

(3) A composition (D) prepared by mixing 55% by weight of propylene homopolymer (Nippon Polychem's trade name, Novatec PPMA-3; m.p., 165° C.) and 45% by weight of heavy calcium carbonate (Bihoku Funka Kogyo's trade name, Soften 1800) having a mean particle size of 3.0 μm was melt-kneaded in a different extruder set at 270° C., and then sheetwise extruded out of it. This was laminated on the back of the 5-fold MD-stretched film obtained in the above step (1) to obtain a four-layered laminate sheet. Next, the 4-layered laminate sheet was cooled to a temperature of 60° C., then again heated up to a temperature of 155° C. and stretched 8.5-fold in the cross direction by the use of a tenter, then annealed at a temperature of 165° C. and cooled to a temperature of 60° C., and thereafter its edges were trimmed away to obtain a stretched resin film having a 4-layered structure (monostretched/monostreched/bistretched/monostretched) and having an overall thickness of 80 μm (A/B/C/D=5 μm/10 μm/50 μm/15 μm).

(4) The film was subjected to corona discharge treatment on both sides thereof by the use of a corona discharge processor (Kasuga Electric's trade name HF400F). In the corona discharge treatment, an aluminium electrode having a length of 0.8 m was used; a silicone-coated roll was used as a treater roll; the gap between the electrode and the roll was 5 mm; the line processing speed was 15 m/min; and the applied energy density was 4,200 J/m$^2$.

Production Example 2

Production of Stretched Resin Film (1) A composition (A) was prepared by mixing 23% by weight of high-density polyethylene (Nippon Polychem's trade name, Novatec HD, HJ360) having a Vicat softening point of 122° C., 16.2% by weight of propylene homopolymer (Nippon Polychem's trade name, Novatec PP MA-3; m.p. 165° C.) having a Vicat softening point of 145° C., 60% by weight of heavy calcium carbonate (Maruo Calcium's trade name, Caltex 7) having a mean particle size of 1.1 μm, and 0.2% by weight of aluminium stearate and 0.6% by weight of oleic acid both serving as a lubricant; a composition (B) was prepared by mixing 85% by weight of propylene homopolymer (Nippon Polychem's trade name, Novatec PP MA-8; m.p., 165° C.) and 15% by weight of heavy calcium carbonate (Bihoku Funka Kogyo's trade name, Soften 1800) having a mean particle size of 3.0 μm; and a composition (C) was prepared by mixing 55% by weight of propylene homopolymer (Nippon Polychem's tradename Novatec PPMA-3; m.p., 165° C.) and 45% by weight of heavy calcium carbonate (Bihoku Funka Kogyo's trade name, Soften 1800) having a mean particle size of 3.0 μm. These compositions (A), (B) and (C) were separately melt-kneaded in different extruders set at 270° C., then laminated inside a die and sheetwise coextruded out of it. This was cooled with a cooling device to obtain a three-layered unstretched laminate sheet. Next, this was again heated up to a temperature of 150° C., then stretched 7-fold in the machine direction, and annealed at 155° C. to obtain a stretched resin film having an overall thickness of 80 μm (A/B/C=5 μm/70 μm/5 μm).

(2) The film was subjected to corona discharge treatment on the surface thereof by the use of a corona discharge processor (Kasuga Electric's trade name HF400F). In the corona discharge treatment, an aluminium electrode having a length of 0.8 m was used; a silicone-coated roll was used as a treater roll; the gap between the electrode and the roll was 5 mm; the line processing speed was 15 m/min; and the applied energy density was 4,200 J/m$^2$.

Production Example 3

Production of Stretched Resin Film (1) A composition (A) was prepared by mixing 35% by weight of high-density polyethylene (Nippon Polychem's trade name, Novatec HD, HJ360) having a Vicat softening point of 122° C., 24.2% by weight of propylene homopolymer (Nippon Polychem's tradename, Novatec PP MA-3; m.p. 165° C.) having a Vicat softening point of 145° C., 40% by weight of heavy calcium carbonate (Maruo Calcium's trade name, Caltex 7) having a mean particle size of 1.1 μm, and 0.2% by weight of aluminium stearate and 0.6% by weight of oleic acid both serving as a lubricant; a composition (B) was prepared by mixing 85% by weight of propylene homopolymer (Nippon Polychem's trade name, Novatec PP MA-8; m.p., 165° C.) and 15% by weight of heavy calcium carbonate (Bihoku Funka Kogyo's trade name, Soften 1800) having a mean particle size of 3.0 μm; and a composition (C) was prepared by mixing 55% by weight of propylene homopolymer (Nippon Polychem's tradename Novatec PPMA-3; m.p., 165° C.) and 45% by weight of heavy calcium carbonate (Bihoku Funka Kogyo's trade name, Soften 1800) having a mean particle size of 3.0 μm. These compositions (A), (B) and (C) were separately melt-kneaded in different extruders set at 270° C., then laminated inside a die and sheetwise coextruded out of it. This was cooled with a cooling device to obtain a three-layered unstretched laminate sheet.

(2) Next, the three-layered laminate sheet was cooled to 60° C. with a cooling device, and again heated up to a temperature of 150° C., then stretched 5-fold in the machine direction, thereafter further heated up to a temperature of 155° C. and stretched 6-fold in the cross direction by the use of a tenter, and annealed at 165° C. and then cooled to a temperature of 60° C. Its edges were trimmed away to obtain a stretched laminated resin film having an overall thickness of 80 μm (A/B/C=5 μm/70 μm/5 μm).

(3) The film was subjected to corona discharge treatment on the surface thereof by the use of a corona discharge processor (Kasuga Electric's trade name HF400F). In the corona discharge treatment, an aluminium electrode having a length of 0.8 m was used; a silicone-coated roll was used as a treater roll; the gap between the electrode and the roll was 5 mm; the line processing speed was 15 m/min; and the applied energy density was 4,200 J/m$^2$.

Production Example 4

Production of Component (i) of Coating Agent 100 parts of aqueous 25 wt. % solution of polyethyleneimine (Nippon Shokubai's trade name, Epomin P-1000 (degree of polymerization, 1600), 10 parts of n-butyl chloride and 10 parts of propylene glycol monomethyl ether were put into a four-neck flask equipped with a stirrer, a reflux condenser, a thermometer and a nitrogen gas inlet mouth, stirred in a nitrogen atmosphere, and reacted for modification at a temperature of 80° C. for 20 hours to obtain an aqueous solution of 20 wt. % butyl-modified polyethyleneimine.

Production Example 5

Production of Component (ii) of Coating Agent

Polyaminepolyamide-epichlorohydrin adduct (Nippon PMC's trade name, WS-570; solid content, 12.5% by weight) was prepared as the component (ii) of a coating agent.

Production Example 6

Production of Component (iii) of Coating Agent 35 parts of dimethylaminoethyl methacrylate, 20 parts of ethylmethacrylate, 20 parts of cyclohexyl methacrylate, 25 parts of stearyl methacrylate, 150 parts of ethyl alcohol and 1 part of azobisisobutyronitrile were put into a four-neck flask equipped with a reflux condenser, a thermometer, a glass tube for nitrogen purging and a stirrer, and polymerized in a nitrogen atmosphere at a temperature of 80° C. for 6 hours.

Next, 70 parts of an ethyl alcohol solution of 60 wt. % 3-chloro-2-hydroxypropylammonium chloride was added to it, and further reacted at a temperature of 80° C. for 15 hours, and thereafter ethyl alcohol was evaporated away while water was dropwise added to it. A quaternary ammonium salt-type copolymer having a final solid content of 30% was obtained. The copolymer is an alkyl acrylate-based polymer having a group of the following formula in the molecular chain:

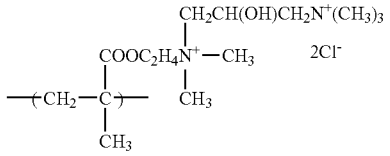

Example 1

The stretched laminated resin film obtained in Production Example 1 was used as a melt thermal transfer recording paper.

Examples 2 to 5

Melt thermal transfer recording papers were obtained in the same manner as in Example 1, for which, however, the blend ratio of the propylene homopolymer, the high-density polyethylene and the inorganic fine powder in the layer A in Example 1 was changed as in Table 1.

Example 6

A melt thermal transfer recording paper was obtained in the same manner as in Example 1, for which, however, the inorganic fine powder in the layer A in Example 1 was changed to heavy calcium carbonate (Bihoku Funka Kogyo's tradename, Soften 1800) having a mean particle size of 3.0 μm.

Example 7

A melt thermal transfer recording paper was obtained in the same manner as in Example 1, for which, however, the high-density polyethylene in the layer A in Example 1 was changed to low-density polyethylene (Nippon Polychem's trade name, Novatec LD, LC604) having a Vicat softening point of 84° C.

Example 8

A melt thermal transfer recording paper was obtained in the same manner as in Example 1, for which, however, the high-density polyethylene in the layer A in Example 1 was changed to ethylene/methyl acrylate (Nippon Polyolefin's trade name, Lexpearl RB5120) having a Vicat softening point of 60° C.

Example 9

The stretched laminated resin film obtained in Production Example 2 was used as a melt thermal transfer recording paper.

Example 10

The stretched laminated resin film obtained in Production Example 3 was used as a melt thermal transfer recording paper.

Example 11

A coating agent comprising 100 parts by weight of the component (i) obtained in Production Example 4, 150 parts by weight of the component (ii) obtained in Production Example 5, and 150 parts by weight of the component (iii) obtained in Production Example 6 was applied to both sides of the stretched laminated resin film obtained in Production Example 1 in such a manner that the thickness of the coating film could be 0.06 g/m$^2$, and then dried to obtain a film-type melt thermal transfer recording paper.

Example 12

A melt thermal transfer recording paper was obtained in the same manner as in Example 1, for which, however, the blend ratio of the propylene homopolymer and the high-density polyethylene in the layer A in Example 1 was changed as in Table 1, and 0.5% by weight of maleic acid-modified polypropylene (Sanyo Chemical's trade name, Yumex 1001) having a degree of maleic acid modification of 5% was added to the layer A as a dispersant.

Examples 13 to 17

Melt thermal transfer recording papers were obtained in the same manner as in Example 12, for which, however, the blend ratio of the propylene homopolymer, the high-density polyethylene, the inorganic fine powder and the dispersant in the layer A in Example 12 was changed as in Table 1.

Comparative Example 1

A stretched resin film described in Example 1 in JP-A 8-80684 was prepared. The surface layer (monostretched) of the film was analyzed and evaluated in the following Test Examples.

Comparative Example 2

A stretched resin film described in Example 1 in JP-A 2001-219661 was prepared. The surface layer (monostretched) of the film was analyzed and evaluated in the following Test Examples.

Comparative Examples 3 to 7

Melt thermal transfer recording papers were obtained in the same manner as in Example 1, for which, however, the blend ratio of the propylene homopolymer, the high-density polyethylene and the inorganic fine powder in the layer A in Example 1 was changed as in Table 2.

Comparative Example 8

A film was obtained in the same manner as in Example 5, for which, however, the polypropylene homopolymer in the layer A in Example 5 was changed to Chisso Polypro F8090 (Chisso's trade name; m.p., 148° C.) having a Vicat softening point of 131° C., and this was evaluated. The results are given in Table 2.

The melt thermal transfer recording papers produced in Examples and Comparative Examples were analyzed in point of the surface-coated areal ratio after dummy (non-ink) printing and the center line average height (Ra), according to the above-mentioned test methods, and the results are given in Table 1 and Table 2. Further, these were tested according to the test methods mentioned below.

Test Example 1

Evaluation of Melt Thermal Transferability

The melt thermal transfer recording papers produced in Examples and Comparative Examples were printed and their melt thermal transferability was evaluated. For printing on them, used were a barcode printer (Zebra's trade name Zebra 140XiII) and a meltable wax ink ribbon (Fujicopian's trade name, FTR). The printing condition was so controlled that the temperature of the thermal head (measured with a thermocouple fitted to the thermal head) could be 110° C.

The temperature of the recording paper was 110° C., and the printing speed was 3 inch/sec. Under the condition, the meltable wax ink ribbon was transferred onto the recording papers. The barcode (CODE 39) thus printed on the recording papers in a mode of melt thermal transfer printing was read with a barcode reader (Fuji Electric Refrigerator's trade name, Lasercheck II) at a temperature of 23° C. and a relative humidity of 50%, and the read ratio was evaluated according to ANSI (American national Standards Institute) GRADE. ANSI GRADE includes 6 levels of A to D, F and No Decode; and A indicates the best print condition. The results are given in Table 1 and Table 2.

A: Very good (the printed barcode is neither faint nor patchy at all, and can be accurately read in one try with a commercial barcode reader).

B: Good (basically, the printed barcode can be read in one try, but may require another try).

C: Average (the printed barcode is somewhat faint or patchy, and requires a few tries in reading it).

D, F: No good (the lines of the printed barcode are cut, and this requires more tries than the level C, and this is impracticable).

No Decode: No good (the printed barcode cannot be recognized as CODE 39).

Test Example 2

Evaluation of Solvent-Resistant Rubbing Resistance

The printed matter obtained in Example 1 was evaluated according to the method of JIS-L-0849-1996. Concretely, using a friction tester for color fastness test (Suga Test Instruments' trade name, FR-II Model), the printed sample was rubbed 50 times with a white cotton cloth for friction all the time wetted with ethanol suitably applied thereto, under a load of 200 g. The printed barcode was read with a barcode reader, and its solvent-resistant rubbing resistance was evaluated according to ANSI GRADE. Levels A to C in ANSI GRADE are practicable. The results are given in Table 1 and Table 2.

Test Example 3

Evaluation of Printability

For printability evaluation, used were a printer (Akari Seisakusho's trade name, RI-III Model Printability Tester) and a printing ink (T&K Toka's trade name, Bestcure 161 (black)).

The melt thermal transfer recording papers were stored in an atmosphere having a temperature of 23° C. and a relative humidity of 50% for 3 days. Using the above-mentioned printer and ink, these were printed on their coated face to have an ink thickness of 1.5 g/m$^3$. The Macbeth density of the printed surface of each sample was measured with a light reflection densitometer, Macbeth Densitometer (trade name by Colmogen, US). In the following evaluation criteria, the levels C and higher are practicable. The results are given in Table 1 and Table 2.

A: Macbeth density, 1.8 or more. The transferred density is very good.

B: Macbeth density, from 1.6 to less than 1.8. The transferred density is good.

C: Macbeth density, from 1.4 to less than 1.6. The transferred density is relatively low but is on a practicable level.

D: Macbeth density, less than 1.4. The transferred density is low, and some patterns are problematic.

Test Example 4

Evaluation in Point of Thermal Degradation Product

In forming the resin films of Examples 1 to 17 and Comparative Examples 1 to 8, the die tip was visually checked for the thermal degradation product adhering thereto, after 1 hour from the start of the forming operation.

A: Excellent (little thermal degradation product was at the die tip, and this is on a level of no problem in forming the films).

B: Good (a little thermal degradation product was at the die tip, but there is no problem in forming the films.)

C: Average (some thermal degradation product was at the die tip, and it dropped on the resin film formed, but when the die tip is periodically cleaned, it enables film formation).

D: No good (much thermal degradation product was at the die tip and it frequently dropped on the resin film formed, and this is on an impracticable level).

TABLE 1

| | Example No. | | | | | | | |
|---|---|---|---|---|---|---|---|---|
| | 1 | 2 | 3 | 4 | 5 | 6 | 7 | 8 |
| Polyolefin-based Resin (wt. %) | | | | | | | | |
| propylene homopolymer | 16.2 | 9.2 | 19.2 | 6.2 | 24.2 | 16.2 | 16.2 | 16.2 |
| Thermoplastic Resin having a Vicat softening point of not higher than 140° C. (wt. %) | | | | | | | | |
| high-density polyethylene (Vicat softening point, 122° C.) | 23 | 30 | 20 | 33 | 35 | 23 | | |
| low-density polyethylene (Vicat softening point, 84° C.) | | | | | | | 23 | |
| ethylene-methyl acrylate (Vicat softening point, 60° C.) | | | | | | | | 23 |
| Inorganic Fine Powder (wt. %) | | | | | | | | |
| Caltex (mean particle size = 1.1 μm) | 60 | 60 | 60 | 60 | 40 | | 60 | 60 |
| Soften 1800 (mean particle size = 3.0 μm) | | | | | | 60 | | |
| Lubricant (wt. %) | 0.8 | 0.8 | 0.8 | 0.8 | 0.8 | 0.8 | 0.8 | 0.8 |
| Dispersant (wt. %) | | | | | | | | |
| Resin having a Vicat softening point of not higher than 140° C., relative to 100 parts by weight of polyolefin-based resin (wt. pt.) | 142 | 326 | 104 | 532 | 145 | 142 | 142 | 142 |
| Draw Ratio of Layer A | 8.5 | 8.5 | 8.5 | 8.5 | 8.5 | 8.5 | 8.5 | 8.5 |
| Center Line Average Height (Ra) | 0.65 | 0.70 | 0.60 | 0.75 | 0.55 | 0.75 | 0.70 | 0.70 |
| surface-coated areal ratio after dummy (non-ink) printing | 70 | 80 | 50 | 90 | 70 | 70 | 75 | 80 |
| Melt Thermal Transferability | | | | | | | | |
| ink transferability (ANSI GRADE) | A | A | A | A | A | A | A | A |
| solvent-resistant rubbing resistance (ANSI GRADE) | B | B | B | B | B | C | C | C |
| Printability | | | | | | | | |
| ink transferability (Macbeth density) | B | B | B | B | B | B | B | B |
| Formation of Thermal Degradation Product | A | A | A | A | A | A | A | A |

| | Example No. | | | | | | | | |
|---|---|---|---|---|---|---|---|---|---|
| | 9 | 10 | 11 | 12 | 13 | 14 | 15 | 16 | 17 |
| Polyolefin-based Resin (wt. %) | | | | | | | | | |
| propylene homopolymer | 16.2 | 24.2 | 16.2 | 16.2 | 15.7 | 15.2 | 15.2 | 13.7 | 11.2 |
| Thermoplastic Resin having a Vicat softening point of not higher than 140° C. (wt. %) | | | | | | | | | |
| high-density polyethylene (Vicat softening point, 122° C.) | 23 | 35 | 23 | 22.5 | 22.5 | 22.5 | 22 | 20.5 | 18 |
| low-density polyethylene (Vicat softening point, 84° C.) | | | | | | | | | |
| ethylene-methyl acrylate (Vicat softening point, 60° C.) | | | | | | | | | |

TABLE 1-continued

| | | | | | | | | | |
|---|---|---|---|---|---|---|---|---|---|
| Inorganic Fine Powder (wt. %) | | | | | | | | | |
| Caltex (mean particle size = 1.1 μm) | 60 | 40 | 60 | 60 | 60 | 60 | 60 | 60 | 60 |
| Soften 1800 (mean particle size = 3.0 μm) | | | | | | | | | |
| Lubricant (wt. %) | 0.8 | 0.8 | 0.8 | 0.8 | 0.8 | 0.8 | 0.8 | 0.8 | 0.8 |
| Dispersant (wt. %) | | | | 0.5 | 1 | 1.5 | 2 | 5 | 10 |
| Resin having a Vicat softening point of not higher than 140° C., relative to 100 parts by weight of polyolefin-based resin (wt. pt.) | 142 | 145 | 142 | 139 | 143 | 148 | 145 | 150 | 161 |
| Draw Ratio of Layer A | 7 | 30 | 8.5 | 8.5 | 8.5 | 8.5 | 8.5 | 8.5 | 8.5 |
| Center Line Average Height (Ra) | 0.75 | 0.55 | 0.65 | 0.65 | 0.65 | 0.70 | 0.80 | 0.90 | 1.2 |
| surface-coated areal ratio after dummy (non-ink) printing | 70 | 70 | 70 | 70 | 70 | 70 | 75 | 75 | 75 |
| Melt Thermal Transferability | | | | | | | | | |
| ink transferability (ANSI GRADE) | A | A | A | A | A | A | A | A | A |
| solvent-resistant rubbing resistance (ANSI GRADE) | B | B | B | A | A | A | A | A | A |
| Printability | | | | | | | | | |
| ink transferability (Macbeth density) | B | B | A | B | B | B | C | C | C |
| Formation of Thermal Degradation Product | A | A | A | A | A | A | B | B | C |

TABLE 2

| | Comparative Example No. | | | | | | | |
|---|---|---|---|---|---|---|---|---|
| | 1 | 2 | 3 | 4 | 5 | 6 | 7 | 8 |
| Polyolefin-based Resin (wt. %) | *1 | *2 | | | | | | |
| propylene homopolymer | | | 29.2 | 33.2 | 7.2 | 39.2 | 19.2 | 24.2 |
| Thermoplastic Resin having a Vicat softening point of not higher than 140° C. (wt. %) | | | | | | | | |
| HDPE (Vicat softening point, 122° C.) | | | 10 | 46 | 12 | 0 | 20 | 35 |
| Inorganic Fine Powder (wt. %) | | | | | | | | |
| Caltex (mean particle size = 1.1 μm) | | | 60 | 20 | 80 | 60 | | 40 |
| Soften 1100 (mean particle size = 6.5 μm) | | | | | | | 60 | |
| Lubricant (wt. %) | | | 0.8 | 0.8 | 0.8 | 0.8 | 0.8 | 0.8 |
| Resin having a Vicat softening point of not higher than 140° C., relative to 100 parts by weight of polyolefin-based resin (wt. pt.) | | | 34 | 142 | 167 | — | 104 | 145 |
| Draw Ratio of Layer A | 7.5 | 7.5 | 8.5 | 8.5 | 8.5 | 8.5 | 8.5 | 8.5 |
| Center Line Average Height (Ra) | 0.30 | 0.65 | 0.50 | 0.35 | 1.4 | 0.40 | 2.7 | 0.35 |
| surface-coated areal ratio after dummy (non-ink) printing | 10 | 10 | 25 | 70 | 70 | 10 | 50 | 90 |
| Melt Thermal Transferability | | | | | | | | |
| ink transferability (ANSI GRADE) | A | A | A | A | B | A | B | A |
| solvent-resistant rubbing resistance (ANSI GRADE) | No Decode | No Decode | D | D | C | F | D | D |
| Printability | | | | | | | | |
| ink transferability (Macbeth density) | A | B | B | B | D | B | D | B |
| Formation of Thermal Degradation Product | A | A | A | A | A | A | A | A |

*1: Stretched resin film described in Example 1 in JP-A 8-80684

*2: Stretched resin film described in Example 1 in JP-A 2001-219661

The present disclosure relates to the subject matter contained in PCT/JP03/11553 filed on Sep. 10, 2003 and Japanese Patent Application No. 264705/2002 filed on Sep. 10, 2002, which are expressly incorporated herein by reference in their entirety.

The foregoing description of preferred embodiments of the invention has been presented for purposes of illustration and description, and is not intended to be exhaustive or to limit the invention to the precise form disclosed. The description was selected to best explain the principles of the invention and their practical application to enable others skilled in the art to best utilize the invention in various embodiments and various modifications as are suited to the particular use contemplated. It is intended that the scope of the invention not be limited by the specification, but be defined claims set forth below.

What is claimed is:

1. A melt thermal transfer recording paper comprising:

a stretched resin film stretched in at least one direction, wherein the stretched resin film contains from 30 to 75% by weight of at least one of an inorganic fine powder and an organic filler and from 25 to 70% by weight in total of a thermoplastic resin having a Vicat softening point, as measured according to JIS-K-7206-1999, of not higher than 140° C., and a polyolefin-based resin having a Vicat softening point, as measured according to JIS-K-7206-1999, of higher than 140° C.; the stretched resin film contains from 326 parts by weight to 532 parts by weight of the thermoplastic resin relative to 100 parts by weight of the polyolefin-based resin; when a barcode is printed on the surface of the stretched resin film with a meltable wax ink ribbon, by the use of a melt thermal transfer recording device at a temperature of 110° C. and at a printing speed of 3 inches/sec, and when the surface of the printed barcode is rubbed 50 times with a white cotton cloth absorbing ethanol, according to JIS-L-0849-1996, then the condition of the thus-rubbed barcode is on a level of A to C in ANSI GRADE.

2. The melt thermal transfer recording paper as claimed in claim 1, wherein the polyolefin-based resin is a propylene-based resin having a Vicat softening point of higher than 140° C.

3. The melt thermal transfer recording paper as claimed in claim 1, wherein the surface of the stretched resin film has a center line average height (Ra) of from 0.4 to 2.5 μm, as measured according to JIS-B-0601-2001.

4. The melt thermal transfer recording paper as claimed in claim 1, in which, when the surface of the stretched resin film is heated by the use of a melt thermal transfer recording device at a temperature of 110° C. and at a printing speed of 3 inches/sec, then the surface-coated areal ratio of the stretched resin film is at least 35%.

5. The melt thermal transfer recording paper as claimed in claim 1, which contains a dispersant.

6. The melt thermal transfer recording paper as claimed in claim 5, wherein the dispersant content is more than 0% by weight and at most 20% by weight.

7. The melt thermal transfer recording paper as claimed in claim 1, wherein the draw ratio in stretching the stretched resin film in one direction is from 2 to 12 times and the areal draw ratio in biaxially stretching it is from 4 to 80 times.

8. The melt thermal transfer recording paper as claimed in claim 1, which has a coating layer that contains the following component (i):

(i) A polyimine copolymer of the following formula (a) or a polyaminepolyamide-ethyleneimine adduct:

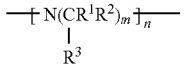

(a)

wherein $R^1$ and $R^2$ each independently represent a hydrogen atom, a linear, branched or alicyclic alkyl group having from 1 to 10 carbon atoms, or an aryl group; $R^3$ represents a hydrogen atom, an alkyl group having from 1 to 20 carbon atoms, an allyl group, an alicyclic alkyl group, an aryl group, or their hydroxide; m indicates an integer of from 2 to 6; n indicates an integer of from 20 to 3000; and (m×n) $R^1$'s, $R^2$'s and $R^3$'s may be individually the same or different.

9. The melt thermal transfer recording paper as claimed in claim 8, wherein the coating layer contains the following component (ii)

(ii) A water-soluble epoxy-type crosslinking agent, isocyanate-type crosslinking agent, formalin-type crosslinking agent, oxazoline-type crosslinking agent or polyaminepolyamide-epichlorohydrin adduct-type crosslinking agent.

10. The melt thermal transfer recording paper as claimed in claim 8, wherein the coating layer contains the following component (iii):

(iii) A polymer-type antistatic agent.

11. The melt thermal transfer recording paper as claimed in claim 1, wherein at least one surface of the stretched resin film is printed.

12. A laminate fabricated by forming an outermost layer on the melt thermal transfer recording paper of claim 1, therefore having a laminate structure with any other resin film.

13. A laminate fabricated by laminating the melt thermal transfer recording paper of claim 1 on a material except resin film.

14. Paper for labels fabricated by laminating the melt thermal transfer recording paper of claim 1 on a release paper via an adhesive therebetween.

15. Paper for labels fabricated by laminating the laminate of claim 12 on a release paper via an adhesive therebetween.

16. A recorded matter of the thermal transfer recording paper of claim 1.

17. A recorded matter of the laminate of claim 12.

18. A recorded matter of the paper for labels of claim 14.

19. The melt thermal transfer recording paper as claimed in claim 1, wherein the stretched resin film contains from 40 to 65% by weight of at least one of an inorganic fine powder and an organic filler.

20. The melt thermal transfer recording paper as claimed in claim 1, wherein the condition of the thus-rubbed barcode is on a level of A or B in ANSI GRADE.

21. The melt thermal transfer recording paper as claimed in claim 1, wherein the stretched resin film contains more than 100 parts by weight and at most 400 parts by weight of the thermoplastic resin relative to 100 parts by weight of the polyolefin-based resin.

22. A melt thermal transfer recording paper comprising:

a solvent and rubbing resistant stretched resin film stretched in at least one direction, wherein the stretched resin film contains from 30 to 75% by weight of at least one of an inorganic fine powder and an organic filler and from 25 to 70% by weight in total of a thermoplastic resin having a Vicat softening point, as measured according to JIS-K-7206-1999, of not higher than 140° C., and a polyolefin-based resin having a Vicat softening point, as measured according to JIS-K-7206-1999, of higher than 140° C.; the stretched resin film contains from 326 parts by weight to 532 parts by weight of the thermoplastic resin relative to 100 parts by weight of the polyolefin-based resin; when a barcode is printed on the surface of the stretched resin film with a meltable wax ink ribbon, by the use of a melt thermal transfer recording device at a temperature of 110° C. and at a printing speed of 3 inches/sec, and when the surface of the printed barcode is rubbed 50 times with a white cotton cloth absorbing ethanol, according to JIS-L-0849-1996, then the condition of the thus-rubbed barcode is on a level of A to C in ANSI GRADE.

23. A melt thermal transfer recording paper comprising:

a surface coatable stretched resin film stretched in at least one direction, wherein the stretched resin film contains from 30 to 75% by weight of at least one of an inorganic fine powder and an organic filler and from 25 to 70% by weight in total of a thermoplastic resin having a Vicat softening point, as measured according to JIS-K-7206 1999, of not higher than 140° C., and a polyolefin-based resin having a Vicat softening point, as measured according to JIS-K-7206-1999, of higher than 140° C.; the stretched resin film contains from 326 parts by weight to 532 parts by weight of the thermoplastic resin relative to 100 parts by weight of the polyolefin-based resin; when a barcode is printed on the surface of the stretched resin film with a meltable wax ink ribbon, by the use of a melt thermal transfer recording device at a temperature of 110° C. and at a printing speed of 3 inches/sec, and when the surface of the printed barcode is rubbed 50 times with a white cotton cloth absorbing ethanol, according to JIS-L-0849-1996, then the condition of the thus-rubbed barcode is on a level of A to C in ANSI GRADE.

* * * * *

UNITED STATES PATENT AND TRADEMARK OFFICE

CERTIFICATE OF CORRECTION

PATENT NO. : 7,776,413 B2
APPLICATION NO. : 11/075665
DATED : August 17, 2010
INVENTOR(S) : Hisao Ochiai et al.

It is certified that error appears in the above-identified patent and that said Letters Patent is hereby corrected as shown below:

On the Title Page

Item (30) (Foreign Application Priority Data), line 31, "2002-246705" should read

-- 2002-264705 --.

Signed and Sealed this
Fifth Day of April, 2011

David J. Kappos

David J. Kappos
*Director of the United States Patent and Trademark Office*